United States Patent [19]

Buring et al.

[11] 4,409,689

[45] Oct. 18, 1983

[54] PIVOT MEANS FOR A LEG GUARD

[76] Inventors: Klas Buring, Tulegatan 27, S-852 35 Sundsvall; Lars Eghamn, PL 2392, S-864 00 Matfors; Jannes Sigurdsson, Hedvägen 8; Rolf Åhlman, Box 6403, both of S-792 00 Mora, all of Sweden

[21] Appl. No.: 376,696

[22] Filed: May 10, 1982

[30] Foreign Application Priority Data

May 19, 1981 [SE] Sweden ..... 8103133

[51] Int. Cl.[3] ..... A41D 13/00; A61F 3/00

[52] U.S. Cl. ..... 2/22; 128/80 C

[58] Field of Search ..... 2/22, 24, 21; 128/80 C, 128/80 R, 88, 80 F

[56] References Cited

U.S. PATENT DOCUMENTS 4,139,002 2/1979 Almedia ..... 2/22

4,353,361 10/1982 Foster ..... 2/22

*Primary Examiner*—Doris L. Troutman

*Attorney, Agent, or Firm*—Kinzer, Plyer, Dorn & McEachran

[57] ABSTRACT

A leg guard comprises a first, shell-like section (1) and second shell-like section (2). The first section (1) is connected to the second section (2) by means of two coaxial pivot pins (4) arranged on each side of the leg guard. A cupped part (3) is pivotally connected to the second section (2) by means of two coaxial pivot pins (5) spaced from the first pivot pins. Two coaxial guide pins (8) connected to the first section are each arranged to slide in a groove or slot in the cupped part (3). The arrangement is such that when the leg guard is bent, the second pivot pins (5) cause the cupped part (3) to move in the longitudinal direction of the leg guard, and the guide means formed by the guide pins (8) and the slot or groove guide the pivotal movement of the cupped part around the second pivot pins.

4 Claims, 4 Drawing Figures

Fig. 1
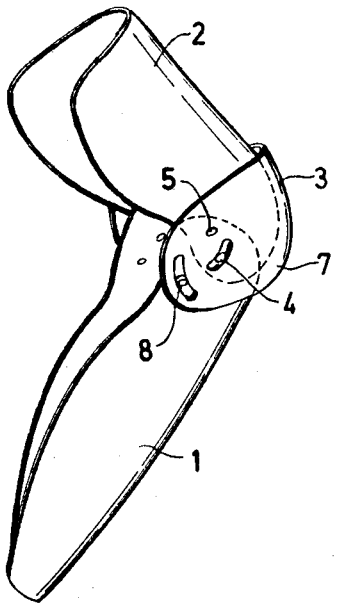
Fig. 2
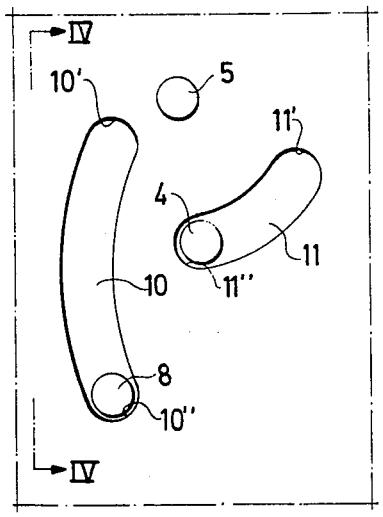
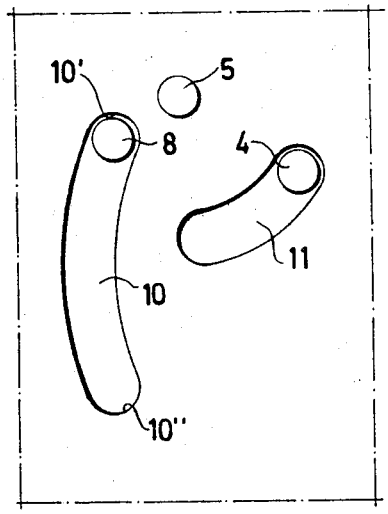
Fig. 3
Fig. 4
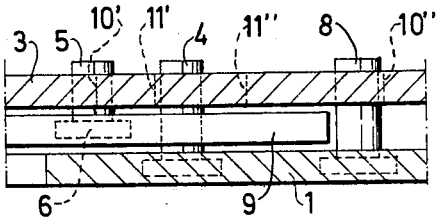

PIVOT MEANS FOR A LEG GUARD

The present invention relates to a pivot means for a leg guard of the kind comprising a first shell-form section and second shell-form section arranged so as to partially overlap one another and pivotally connected together by pivot means; and a cupped part which overlaps said second section and which is intended to protect the knee of the wearer.

A leg guard of this kind is mainly intended for ice-hockey players, and it should be possible to bend such a leg guard so that the first section, which covers that part of the wearer's leg located beneath the knee is able to form an angle of 90° or less with the second section, which covers the thigh of the wearer or that part of his leg above the knee. When the two sections are pivoted or bent relative to one another, an opening will form between the two sections, which opening must be covered by the cupped part of the leg guard in order to afford adequate protection. It is important that the cupped part of the leg guard can be caused to move, during said relative pivoting movement of the first and second guard sections, in a manner to ensure that the knee is constantly covered; thus in a manner to ensure that the cupped part is not rotated to an extent such as to expose said opening, either completely or partially. This represents a serious problem in the art. Furthermore, the cupped part should not move outwardly, away from the first and second guard sections as it moves in response to the relative pivot movement of said sections.

Consequently, the object of the present invention is to provide a pivot means with which these requirements can be realised to the full. This object is achieved with a pivot means according to the invention having the characterizing features set forth in the accompanying claims.

An exemplary embodiment of the invention will now be described in more detail with reference to the accompanying drawing.

FIG. 1 illustrates in perspective a leg guard constructed in accordance with the invention;

FIG. 2 illustrates the pivot means of the invention in an extended position of the leg guard;

FIG. 3 is a view similar to that of FIG. 2, with the leg guard bent to its maximum; and FIG. 4 is a sectional view taken on the line IV—IV in FIG. 2.

The leg guard comprises a first section 1 which is intended to protect that part of the wearer's leg between foot and knee and which is preferably shaped to conform to said leg part, a second section 2, which is intended to protect part of the thigh lying directly above the knee, and a cupped part 3 intended to cover the opening which is unavoidably created between the sections 1 and 2 of the leg guard when the bottom part of the leg forms an angle with the thigh. As will be seen from FIG. 1, the lower-leg protecting section 1 and the thigh-protecting section 2 do not only extend along the front of the lower leg and thigh respectively, but also extend along the outside and inside of the lower leg and thigh. The lower-leg section 1 is pivotally connected to the thigh section 2 by means of a cylindrical pivot 4, which in the illustrated embodiment is assumed to be cast in the lower-leg section 1 or fixedly attached thereto in some other suitable manner. In the illustrated embodiment the guard sections 1 and 2 and the cupped part 3 of the leg guard are assumed to be manufactured from a plastics material having a thickness of, for example, 2–5 mm, although it will be understood that the guard sections and said cupped part may be made of a composite material, such as a reinforced or filled plastics material in combination with metal, for example aluminum or some other suitable material. The pivot 4 is freely rotatable in a hole in the thigh-protecting section 2, and the hole is formed so that there is the least possible play between the pivot 4 and the wall of the cylindrical hole. The cupped part 3, which covers the upper end portion of the lower-leg guard section 1 and the lower end portion of the thigh-guard section 2 in all relative positions between said sections 1 and 2, is pivotally connected to the thigh-guard section 2 by means of a pivot pin 5 having a capped end 6 which is firmly cast in the material of the thigh-guard section 2. The pivot pin 5 is freely rotatable in a hole arranged in the cupped part 3. In order to hold the cupped part 3 in a correct position relative the lower-leg guard section 1 and the thigh-guard section 2, and thus prevent the cupped part from pivoting counterclockwise in the position illustrated in FIG. 1 and exposing the openings 7 between the thigh-guard section and the lower-leg guard section there is provided a guide pin 8 which is fixedly anchored in the lower-leg guard section 1, which freely passes the end edge 9 of the thigh-guard section 2 and which projects into a slot or groove 10 located in the cupped part 3. The ends of the slot or groove 10 are referenced 10' and 10''. The pivot pin 4 projects out from the thigh-guard section 2 and moves in a slot or groove 11 arranged in the cupped part 3. The ends of the groove or slot 11 are referenced 11' and 11''. In the illustrated embodiment the groove 10 is of circular arcuate configuration with its centre of curvature located on the front part of the cupped part 3. The exact position of the centre of curvature and the magnitude of the radius of curvature depends upon the shape of the different parts 1, 2 and 3 of the leg guard, their mutual size and the angle which the lower-leg guard section 1 is conceived to form with the thigh-guard section 2 when said sections are bent or pivoted relative to one another. In the illustrated embodiment, the groove 11 is curved in a circular arcuate fashion, and its centre of rotation lies on the centre of the pivot pin 5. It is emphasized that in certain cases it is possible to use a guide groove or slot 10 which is rectilinear or double-curved, and that the design is dependent on the shape and mutual size of the guard parts 1, 2 and 3. A pivot means of the aforedescribed kind is arranged on both the outside and the inside of the guard, and the pins 4, 5 and 8 on the side lie axially aligned with corresponding pins on the other side.

When the wearer of the described leg guard holds his leg fully stretched, the pivot means will take the position illustrated in FIG. 2. When the angle between the lower-leg section 1 and the thigh section 2 decreases, i.e. the sections pivot on the pivot pin 4, the pivot pin will be moved upwardly from the end edge 11'' of the groove or slot 11 to a final position against the end edge 11' when the sections 1 and 2 are pivoted to the smallest angle possible therebetween, as illustrated in FIG. 3. The pivot pin 5, which joins the thigh-guard section 2 and the cupped part 3 and which lies at a distance of for example, 1–4 cm from the pivot pin 4 during bending or pivotal movement of said sections, will be moved counterclockwise relative to the pivot pin 4, which means that the whole of the cupped part will be moved slightly downwardly in the direction of the lower-leg guard section, while at the same time being rotated slightly together with the thigh-guard section 2. The centre of curvature of the groove 10 does not coincide with the pivot centre formed by the pivot pin 5 of the cupped part 3; more specifically nearer the lower-leg section 1 rotation of the cupped part 3 relative the lower-leg section 1 and the thigh section 2 is completely determined by the curvature of the open groove 10, which is of uniform width. The guide pin 8 has a diameter which is only slightly smaller than the width of the groove 10. The groove 11 has no actual guiding function, but is mainly intended to form a free space for the outwardly projecting end of the pivot pin 4.

The aforedescribed pivot means can be modified in many ways. Thus, the pivot pins and the guide pin may form integral parts of associated lower-leg guard section 1 and thigh-guard section 2 respectively, and, as will be understood, the lower-leg guard section referenced 1 can be formed as a thigh-guard section, and the guard section 2 formed as a lower-leg guard section. As before inferred, the slot 10 may have the form of an inwardly open groove for accommodating the guide pin 8.

We claim:

1. Pivot means for a leg guard of the kind comprising a first shell-like section (1) and second shell-like section (2) arranged so as to overlap each other at least partially and pivotally connected together by pivot means; and a cupped part arranged to overlap the first section and the second section and intended to protect the knee of the wearer, characterized in that the first section (1) is pivotally connected to the second section (2) by means of two mutually coaxial first pivot pins (4) arranged on each side of the leg guard; that the cupped part (3) is pivotally connected to the second section (2) by means of two mutually coaxial pivot pins (5) arranged on both sides of the leg guard at a distance from the first pivot pins; and that each of two coaxial guide pins (8) joined to the first section (1) is arranged to slide in hole means (10) in the cupped part (3), the arrangement being such that when the leg guard is bent said second pivot pins (5) cause the cupped part (3) to move in the longitudinal direction of the leg guard and pivoting movement of the cupped part around the second pivot pins (5) is guided by guide means formed by the guide pins (8) and associated hole means (10).

2. A pivot means according to claim 1, characterized in that the hole means (10) is curved.

3. A pivot means according to claim 1 or claim 2, characterized in that the first pivot pins (4) have outer ends arranged in hole means (11) in the cupped part (3).

4. A pivot means according to any one of claims 1–3, characterized in that the hole means (10, 11) have the form of open slots whose width corresponds substantially to the diameter of respective cylindrical pivot pins and guide pins.

* * * * *